US006769414B2

(12) United States Patent
Rembold et al.

(10) Patent No.: US 6,769,414 B2
(45) Date of Patent: Aug. 3, 2004

(54) FUEL SYSTEM, METHOD FOR OPERATING THE FUEL SYSTEM, COMPUTER PROGRAM AND CONTROL AND/OR REGULATING UNIT FOR CONTROLLING THE FUEL SYSTEM

(75) Inventors: Helmut Rembold, Stuttgart (DE); Jens Wolber, Gerlingen (DE); Uwe Mueller, Hemmingen (DE); Markus Amler, Leonberg-Gebersheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/257,025

(22) PCT Filed: Feb. 6, 2002

(86) PCT No.: PCT/DE02/00427

§ 371 (c)(1),
(2), (4) Date: Feb. 25, 2003

(87) PCT Pub. No.: WO02/063158

PCT Pub. Date: Aug. 15, 2002

(65) Prior Publication Data

US 2003/0154959 A1 Aug. 21, 2003

(30) Foreign Application Priority Data

Feb. 8, 2001 (DE) ..... 101 06 095

(51) Int. Cl.[7] ..... F02M 37/20; F02M 55/02; F02M 59/46

(52) U.S. Cl. ..... 123/514; 123/506; 123/516; 123/179.17

(58) Field of Search ..... 123/457, 458, 123/459, 464, 506, 514, 516, 179.16, 179.17

(56) References Cited

U.S. PATENT DOCUMENTS

| | | | | |
|---|---|---|---|---|
| 5,558,068 A | | 9/1996 | Kunishima et al. | |
| RE36,119 E | | 3/1999 | Kunishima et al. | |
| 5,918,578 A | * | 7/1999 | Oda | 123/456 |
| 6,016,786 A | * | 1/2000 | Rodriquez-Amaya et al. | 123/299 |
| 6,223,725 B1 | * | 5/2001 | Onishi et al. | 123/447 |
| 6,293,253 B1 | * | 9/2001 | Arnold et al. | 123/458 |

FOREIGN PATENT DOCUMENTS

| | | |
|---|---|---|
| DE | 197 53 155 A1 | 11/1997 |
| DE | 198 18 421 A1 | 4/1998 |

* cited by examiner

*Primary Examiner*—Weilun Lo
(74) *Attorney, Agent, or Firm*—Ronald E. Greigg

(57) ABSTRACT

A fuel system serves to supply fuel to an internal combustion engine includes a reservoir and a first fuel pump whose input is connected to the reservoir and a second fuel pump whose input is connected to the first fuel pump. At least one injection valve is connected to the second fuel pump and can supply fuel at least indirectly to a combustion chamber. A leakage line is provided between the second fuel pump and the reservoir. In order to permit a reliable hot start of the engine with a simultaneously low strain on the components, the leakage line is provided with a valve device which has a shutoff function and a pressure relief function that are connected in parallel with each other.

18 Claims, 4 Drawing Sheets

FUEL SYSTEM, METHOD FOR OPERATING THE FUEL SYSTEM, COMPUTER PROGRAM AND CONTROL AND/OR REGULATING UNIT FOR CONTROLLING THE FUEL SYSTEM

CROSS-REFERENCE TO RELATED APPLICATIONS

This application is a 35 USC 371 application of PCT/DE 02/00427, filed on Feb. 6, 2002.

BACKGROUND OF THE INVENTION

1. Field of the Invention

The invention relates to a fuel system for delivering fuel to an internal combustion engine, with a reservoir, a first fuel pump whose input side is connected to the reservoir, a second fuel pump whose input side is connected to the first fuel pump, at least one injection valve that is connected to the second fuel pump and can supply fuel at least indirectly to a combustion chamber, and a leakage line provided between the second fuel pump and the reservoir.

2. Description of the Prior Art

A fuel system of the kind described above is known from the market. In the known fuel system, a first fuel pump delivers fuel from a fuel reservoir to a second fuel pump by means of a fuel line. The second fuel pump is a high-pressure fuel pump, which delivers the fuel at a very high pressure into a fuel accumulation line (also referred to as the "rail"). From there, the fuel travels to at least one injection valve through which the fuel finally travels into the combustion chamber.

Normally, the number of injection valves is equal to the number of cylinders in the engine. The fuel system can be designed so that the injection valve injects the fuel directly into a combustion chamber of the engine. In the known fuel system, a single cylinder piston pump is used as the high-pressure fuel pump. Leakage fuel, which passes through the gap between the cylinder and the piston, is returned from the high-pressure fuel pump to the reservoir by means of the leakage line. This eases the burden on the piston seal of the single cylinder piston pump used.

Supplying fuel to the combustion chambers of the engine during the starting process is a fundamental problem in fuel systems. In the known fuel system, a valve device assures that during the starting process, the first fuel pump supplies the fuel to the injection valves at an increased delivery pressure. In many cases, this increased delivery pressure is sufficient to start the engine in an extremely short period of time. The increased delivery pressure can in many cases compress a gas bubble possibly present in the fuel connection between the first fuel pump and the second fuel pump, thus assuring a reliable operation of the engine.

The object of the current invention is to modify a fuel system of the type mentioned at the beginning so that the starting and operating behavior of an engine that is equipped with the fuel system is further improved at high operating temperatures and the service life of the fuel system is as long as possible.

In a fuel system of the type mentioned at the beginning, this object is attained by virtue of the fact that the leakage line contains a valve device with a shutoff function and a pressure relief function that are connected in parallel with each other.

SUMMARY OF THE INVENTION

Providing a valve device with a shutoff function in the leakage line maintains the increased initial pressure in the fuel connection between the first and second fuel pump after the engine is turned off. Shutting off the leakage line after the engine is turned off mainly prevents fuel from passing through the gap between the movable pump element and the boundary of the pump chamber of the second fuel pump and flowing back into the reservoir. This would lead to a gradual decrease of the pressure in the fuel connection upstream of the second fuel pump.

Maintaining the pressure after a hot engine is turned off prevents gas bubbles from forming in the connection between the first and second fuel pump. Such gas bubbles form when the fuel disposed in the fuel lines between the fuel pumps and is heated by thermal conduction from the engine. However, if the pressure is maintained even when the engine is turned off, as is possible with the fuel system according to the invention, then the formation of such gas bubbles can be prevented to a large extent, which considerably improves the starting behavior of an engine equipped with the fuel system according to the invention.

However, in order to keep the stress on the pressurized components of the fuel system to a minimum, the valve device in the leakage line also has a pressure relief function in addition to the shutoff function. After the hot engine is turned off, the heating of the fuel and the accompanying expansion of the fuel in the fuel line between the first and second fuel pump could cause an impermissible pressure increase in this region. Such an impermissible pressure increase is prevented by the pressure relief function of the valve device. The components in the fuel connection upstream of the high-pressure fuel pump are consequently protected from impermissibly high pressures even when the engine is turned off, which extends their service life. In addition, less expensive components designed for lower pressures can also be used.

The fuel system according to the invention consequently assures a favorable hot starting behavior of the correspondingly equipped engine; on the other hand, the fuel system is assured of being reliable and the stress on the pressurized components of the fuel system is kept to a minimum.

A first modification discloses that the same valve element is used for both functions in the valve device. A corresponding valve device is very small.

It is also particularly preferable that the shutoff function of the valve device can be electrically triggered. This makes it possible, when the motor control unit signals that the engine is turned off, for the shutoff function of the valve device to be activated by a simple control signal.

An easily manufactured, small embodiment of a valve device with a combined shutoff and pressure relief function is comprised in that the valve device has a valve element that is prestressed to perform the pressure relief function and can be electrically actuated counter to the prestressing force in order to disable the shutoff function.

It is particularly advantageous for the valve device to be situated in the vicinity of the engine, particularly in the vicinity of the second fuel pump. For example, it is conceivable to accommodate the valve device in the housing of the second fuel pump. Such a placement has the following advantage:

During operation of the internal combustion engine and therefore also during the operation of the second fuel pump, the shutting off of the leakage line is disabled. The leakage line is therefore largely unpressurized. Due to thermal conduction from the hot engine, the fuel in the leakage line is also heated up and vaporizes. Consequently, the leakage line contains only vaporous fuel at first after the engine is turned off.

If the shutoff function of the valve device is activated and the leakage line is closed when the engine is turned off, then situating the valve device far away from the second fuel pump would cause the closed system between the first fuel pump, the second fuel pump, and the valve device to contain a significant vaporous fuel volume at first. After cooling, fuel from the pump chamber can travel into this vaporous fuel volume, for example by means of a piston guidance gap of the second fuel pump (the gap between the piston and the housing), which can in turn lead to vapor formation in the pump chamber. However, if the valve device is situated as close as possible to the second fuel pump, then this vaporous fuel volume is only very small in any case and consequently cannot lead to any problems when the engine is restarted.

However, it is also possible for the valve device to be disposed in the vicinity of the reservoir. In this instance, the second fuel pump is provided with a bypass line that contains a throttle restriction and leads from the input of the second fuel pump to the leakage line. The cross section of the throttle restriction is selected so that during normal operation, the increase in the temperature of the reservoir is less than a limit value. This modification of the invention is based on the following concept:

Normally, the first fuel pump supplies the second fuel pump with a greater fuel quantity than is sent onward by the second fuel pump. In the current exemplary embodiment, this excess fuel is conveyed past the pump chamber and toward the beginning of the leakage line by means of the bypass line, which is contained in the second fuel pump, e.g. preferably in the housing wall. Consequently, during normal operation of the engine, in which the shutoff function of the valve device in the leakage line is in fact deactivated, a constant flushing flow is conveyed through the leakage line. This prevents fuel from remaining for a longer time in the leakage line and being heated by the leakage line so that it vaporizes.

Thus from the start, this modification according to the invention prevents vapor bubbles from forming in the leakage line. The fuel conveyed past the pump chamber can also be used to cool the second fuel pump, which further improves the hot operation of the fuel system and the engine equipped with it. However, care must be taken that the fuel heated during the cooling process in the second fuel pump does not cause an impermissible increase in the temperature of the fuel in the reservoir. This is assured through an appropriate design of the throttle restriction.

The invention also relates to a method for operating the fuel system of the type mentioned above. The valve device provided functions optimally when the shutoff function of the valve device is activated immediately after the engine is turned off and is deactivated immediately after the engine is started. The activation of the shutoff function of the valve device causes the valve device to close, whereas the deactivation of the shutoff function causes the valve device to open. With an electric actuation of the valve device, the shutoff function of the valve device is preferably activated when it is without current, whereas it is deactivated when supplied with current.

In a particularly preferable modification of this method, the first fuel pump continues to operate for a limited time after the engine is turned off. This ensures that the pressure in the associated region of the fuel system corresponds to the maximal pressure predetermined by the opening pressure of the pressure relief function of the valve device.

The increase of the pressure in the vicinity upstream of the second fuel pump, however, is only necessary when the engine is turned off when hot. It is therefore particularly preferable if the parameters relevant for a hot start of the engine are recorded and the first fuel pump and/or the valve device are triggered as a function of the recorded parameters.

It is particularly preferable if the parameters include a cooling water temperature and/or an intake air temperature and/or a speed and/or a load.

The pressure at the input of the second fuel pump can be adjusted in a particularly simple fashion by means of the speed of the first fuel pump.

The invention also relates to a computer program, which is suitable for executing the method mentioned above, when it is run on a computer. It is particularly preferable if the computer program is stored in a memory, in particular a flash memory.

The invention also relates to a control and/or regulating unit for controlling the fuel system described above; it is preferable if the control and/or regulating unit is provided with a computer program of the type described above.

BRIEF DESCRIPTION OF THE DRAWINGS

Exemplary embodiments of the invention will be explained in detail below in conjunction with the accompanying drawings, in which.

DESCRIPTION OF THE PREFERRED EMBODIMENTS

Figure 1:
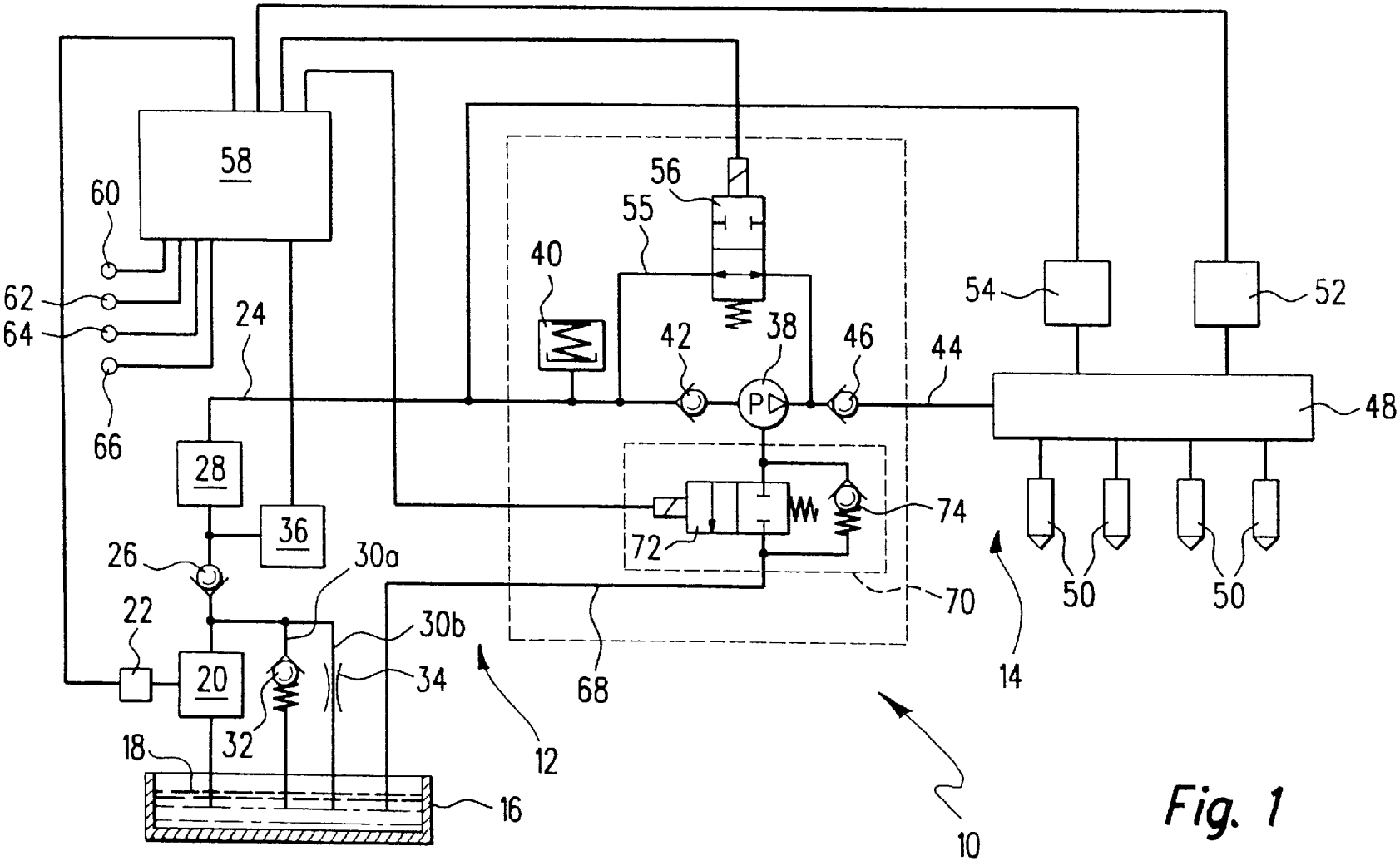
FIG. 1 shows a schematic block circuit diagram of a first exemplary embodiment of a fuel system.

In FIG. 1, a fuel system is labeled as a whole with the reference numeral 10. It includes a low-pressure region 12 and a high-pressure region 14. First, the low-pressure region 12:

This region includes a reservoir 16 in which fuel 18 is stored. The fuel 18 is supplied from the reservoir 16 by a first fuel pump 20. This first fuel pump is an electric fuel pump, which is triggered by a clock module 22. The electric fuel pump 20 feeds into a low-pressure fuel line 24. Downstream of the electric fuel pump 20 in the flow direction, first a check valve 26 and then a filter 28 are provided. In the flow direction upstream of the check valve 26, a branch line 30 branches off from the low-pressure fuel line 24 and leads back to the reservoir 16. The branch line 30 splits into two parallel branches 30*a* and 30*b*. Branch 30*a* contains a pressure relief valve 32, while branch 30*b* contains a throttle 34. A pressure sensor 36 detects the pressure in the low-pressure fuel line 24.

The low-pressure fuel line 24 leads to a second fuel pump 38. This second fuel pump is driven in a manner that is not shown in detail here by the crankshaft of an internal combustion engine (not shown). The second fuel pump 38 is a single piston high-pressure pump. Upstream of a high-pressure pump 38, the low-pressure fuel line 24 also contains a pressure damper 40 and a check valve 42.

On the output side, the high-pressure pump 38 feeds into a fuel line 44, which leads to a fuel accumulation line 48 by means of a check valve 46. The fuel accumulation line 48 is in turn connected to fuel injection valves 50, which inject the fuel into a combustion chamber, not shown, of the internal combustion engine. A pressure sensor 52 detects the pressure in the fuel accumulation line 48.

In order to prevent an excess pressure in the fuel accumulation line 48, which could impair the functional capability of the injection valves 50, the fuel accumulation line 48 is provided with a pressure relief valve 54, which is in turn fluidically connected by means of a line (unnumbered) to the low-pressure fuel line 24. The pressure in the fuel line 44 and the fuel accumulation line 48, i.e. in the high-pressure region 14 of the fuel system 10, is controlled by means of a quantity control valve 56, which connects the region of the fuel line 44 between the check valve 46 and the high-pressure pump 38 to the region of the low-pressure fuel line 24 between the check valve 42 and the pressure damper 40.

The fuel system 10 also includes a control and regulating unit 58, which among other things, receives signals from a temperature sensor 60 that detects the temperature of the cooling water of the engine. In the same way, a sensor 62 is also provided for detecting the temperature of the intake air and likewise sends signals to the control and regulating unit 58. A sensor 64 supplies the control and regulating unit 58 with data regarding the speed of the engine and a sensor 66 provides data regarding the current load of the engine. The control and regulating unit 58 also receives signals from the pressure sensor 36 of the low-pressure region 12 of the fuel system 10 and from the pressure sensor 52 of the high-pressure region 14 of the fuel system 10.

A leakage line 68 leads from the high-pressure pump 38 back to the reservoir 16. In the immediate vicinity of the high-pressure pump 38, the leakage line 68 contains a valve device 70. As symbolically depicted in FIG. 1, the valve device 70 has a shutoff function 72 and a pressure relief function 74, which are connected in parallel with each other.

The high-pressure pump 38 and the valve device 70 will now be explained in detail in conjunction with FIG. 2:

As already explained above, the high-pressure pump is a single piston pump. In FIG. 2, the piston is labeled with the reference numeral 76. It is driven by means of a cam drive 78. The piston 76 is guided in a cylinder housing 80. The top of the piston 76 and the cylinder housing 80 define a pump chamber 82. The pump chamber 82 is in turn sealed in relation to the cam drive 78 by a gap seal, which is disposed between the piston 76 and the cylinder housing 80. Furthermore, a piston seal 84 is provided, which is affixed to the housing. The leakage line 68 branches from an annular groove 86 directly above the piston seal 84. This relieves the burden on the piston seal 84 during operation.

The valve device 70 is provided with only a single valve element 88, which is used for the shutoff function 72 and also for the pressure relief function 74. The valve element 88 has an elongated piston 90 that is guided in housing 89 and supports a plate 92 made of a soft magnetic material at its upper end in FIG. 2. The plate 92 is acted on by a compression spring 94, which loads the bottom end of the piston 90 of the valve element 88 against an annular rib 96, which is formed in a flow chamber 98 downstream of an inlet 100 of the valve device 70. The flow chamber 98 is provided with a radial outlet 102, which is connected to the section of the leakage line 68 that leads to the reservoir 16.

The housing 89 of the valve device 70 is closed at the top by a cover 104, which has a concentric annular groove (unnumbered) on its inside oriented toward the valve element 88, into which an annular electromagnet 106 is inserted. The cover 104 of the valve device 70 is permanently attached to the housing 89 by means of a caulking 108.

The fuel system 10 shown in FIGS. 1 and 2 functions in the following manner:

During normal operation, i.e. at the normal operating temperature of the engine (this is determined by the control and regulating unit 58 based on the signals produced by the temperature sensor 60, the temperature sensor 62, the speed sensor 64, and the load sensor 66), the electric fuel pump 20 supplies the fuel 18 from the reservoir 16 into the fuel line 24 to the high-pressure pump 38. The high-pressure pump 38 sends the fuel, which has been pre-compressed by the electric fuel pump 20, onward with an additional pressure increase into the fuel line 44 to the fuel accumulation line 48. The pressure relief device 32 and the throttle 34, which are otherwise embodied as a modular unit with the electric fuel pump 20, accelerate and facilitate the production of a stable initial pressure in the low-pressure region 12 of the fuel system 10 when the electric fuel pump is switched on.

The pressure sensor 52 and the quantity control valve 56 are part of a closed control loop, which is used to adjust the fuel quantity delivered by the high-pressure pump 38 into high-pressure region 14 of the fuel system 10. The control and regulating unit 58 triggers the valve device 70 to permit a free flow from the high-pressure pump 38 to the reservoir 16 through the leakage line 68. The control and regulation occur in accordance with a computer program, which is stored in the control and regulating unit. It is therefore possible for fuel, which passes through the gap seal between the piston 76 and the cylinder housing 80, into the annular groove 86, to flow back to the reservoir 16 by means of the leakage line 68. This relieves the pressure burden on the piston seal 84.

The opening of the valve device 70, i.e. the deactivation of the shutoff function 72, is achieved by supplying current to the annular magnet 106. The annular magnet 106 consequently attracts the soft magnetic plate 92, which in turn lifts the piston 90 up from the annular rib 96, which constitutes a valve seat.

If the engine is turned off, the control and regulating unit 58 uses the temperature sensor 60 for the cooling water to check whether the engine is hot. If so, the control and regulating unit 58 deactivates the shutoff function 72 of the valve device 70. The annular magnet 106 is consequently without current, as a result of which the compression spring 94 pushes the piston 90 against the annular rib 96. The path from the high-pressure pump 38 through the leakage line 68 to the reservoir 16 is consequently blocked. At the same time, the control and regulating unit 58 triggers the module 22 of the electric fuel pump 20 so that the electric fuel pump 20 continues to operate for a short time. This causes an increase in the pressure of the fuel in the low-pressure fuel line 24 up to the maximal pressure predetermined by the pressure relief valve 32 and the pressure relief function 74 of the valve device 70.

In this regard, it is suitable for the maximal pressure predetermined by the pressure relief function 74 of the valve device 70 and the maximal pressure predetermined by the pressure relief valve 32 to be essentially the same. The pressure relief function 74 of the valve device 70 is produced by virtue of the fact that a pressure difference between the inlet 100 and the outlet 102 of the valve device 70 acts on the piston 90 counter to the prestressing force of the compression spring 94. If the pressure difference exceeds a particular amount, then the piston 90 lifts up from the annular rib 96. This opens the way for excessively pressurized fuel at the inlet 100 of the valve device 70.

After the engine is turned off, thermal conduction can lead to a heating of the low-pressure fuel line 24. As a result, the fuel 18 in the low-pressure fuel line 24 is also heated up and expands. This in turn leads to a pressure increase inside the low-pressure fuel line 24. The prestressing force of the spring 94 and the opening pressure of the pressure relief function 74 of the valve device 70 are appropriately chosen to prevent damage to components of the low-pressure fuel line and the entire low-pressure region 12.

The leakage line 68 and the valve device 70 disposed in it make it possible to maintain an elevated pressure in the low-pressure fuel line 24 when a hot engine is turned off, without a danger of damage to components in the low-pressure region 12 of the fuel system 10 due to a heating of the fuel in the low-pressure fuel line 24. Consequently, a fuel system 10 of this kind considerably improves the starting behavior of a hot engine, without reducing the service life of the components.

Figure 2:
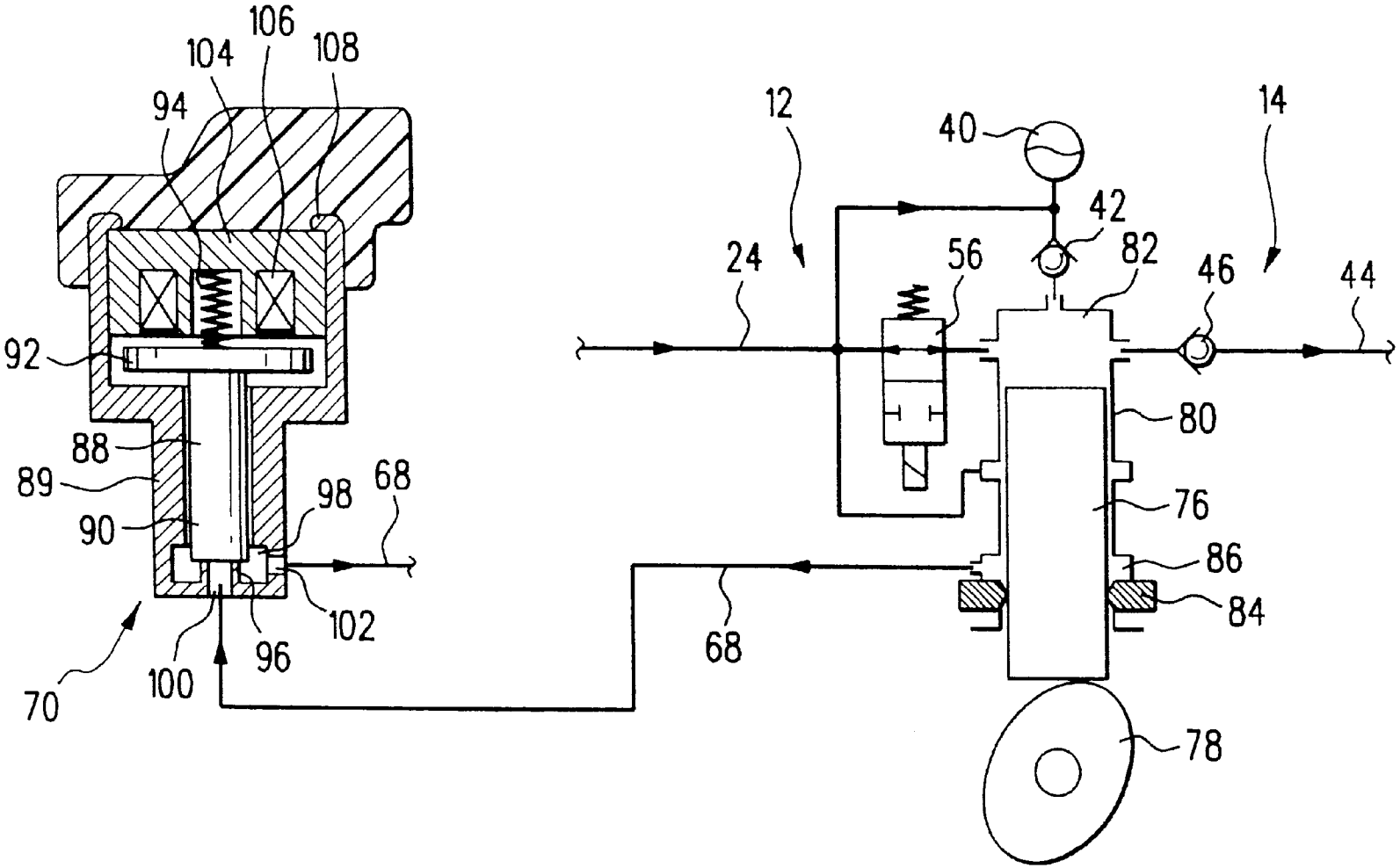
FIG. 2 shows a schematic detailed depiction of a second fuel pump and a valve device of the fuel system from FIG. 1.
Figure 3:
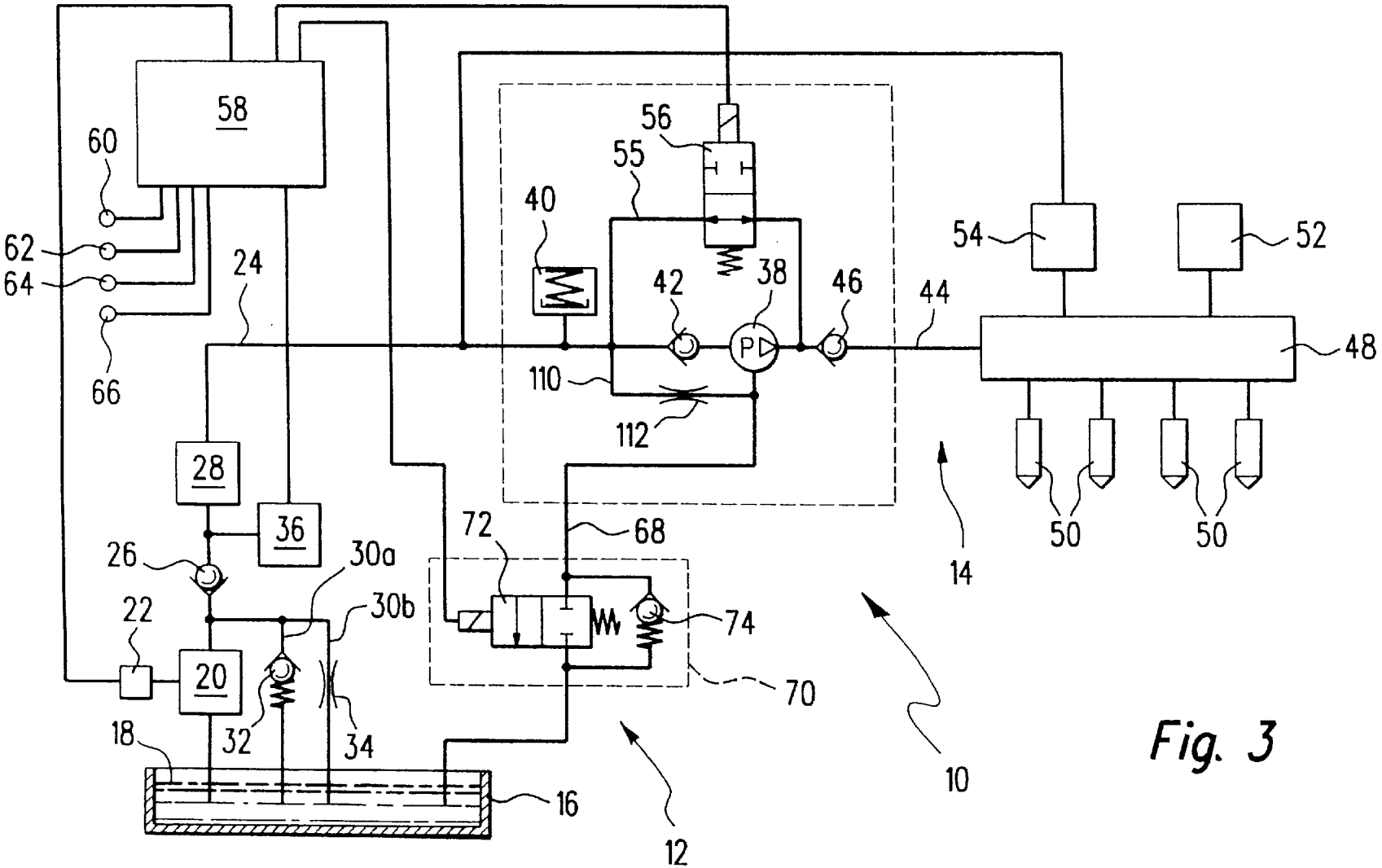
FIG. 3 shows a depiction similar to FIG. 1 of a second exemplary embodiment of a fuel system.

The discussion will now center on FIG. 3, which depicts a second exemplary embodiment of a fuel system 10. Those elements or parts, which have functions equivalent to elements or parts in the exemplary embodiment described in conjunction with FIGS. 1 and 2, are provided with the same reference numerals and will not be explained again in detail.

By contrast with the exemplary embodiment shown in FIGS. 1 and 2, in the exemplary embodiment shown in FIG. 3, the valve device 70 is not disposed in the vicinity of the high-pressure pump 38, but in the vicinity of the reservoir 16. In addition, a bypass line 110 is provided in the vicinity of the high-pressure pump 38, leading from a region of the low-pressure fuel line 24 between the pressure damper 40 and the check valve 42 to a region of the leakage line 68 between the high-pressure pump 38 and the valve device 70. The bypass line 110 contains a throttle 112. The bypass line 110 and the throttle 112 are provided for the following reason:

If the valve device 70 is not disposed in the vicinity of the high-pressure pump 38, as in the current exemplary embodiment, then during normal operation of the fuel system 10, thermal conduction from the engine can heat the leakage line 68 and the fuel contained in it. Since the valve device 70 is in fact open during normal operation, the fuel contained in the leakage line 68 is essentially unpressurized. Because of the heating, this fuel in the leakage line 68 can consequently vaporize. After the engine is turned off, if the valve device 70 is closed, then it would also enclose vapor bubbles contained in the leakage line 68. This could lead to a problem when restarting.

In order to prevent this, even during normal operation, fuel is conveyed past the pump chamber 82 of the high-pressure pump 38 into the leakage line 68. This is possible since the electric fuel pump 20 normally sends the high-pressure pump 38 a greater quantity of fuel than this high-pressure pump 38 sends onward into the high-pressure region 14 of the fuel system 10. During normal operation of the fuel system 10, there is thus a more or less constant fuel flow through the leakage line 68 back to the reservoir 16. On the one hand, this prevents "stagnant" fuel in the leakage line 68 from heating up and vaporizing and on the other hand, it flushes vapor bubbles possibly contained in this line out in the direction of the reservoir 16.

The throttle 112 limits the quantity of fuel conveyed past the pump chamber 82 so that the easily heated fuel flowing back via the leakage line 68 does not impermissibly heat the fuel in the reservoir 16, which could in turn lead to vaporization problems there. If the engine is then turned off and the valve device 70 is closed, then it can be assumed that the leakage line 68 essentially contains only liquid fuel and no vapor bubbles.

In this exemplary embodiment, therefore, the valve device 70 can be disposed in the vicinity of the reservoir 16, which is occasionally desirable for space considerations, and at the same time, a more reliable hot starting behavior and a reliable operation of the engine can be achieved.

Figure 4:
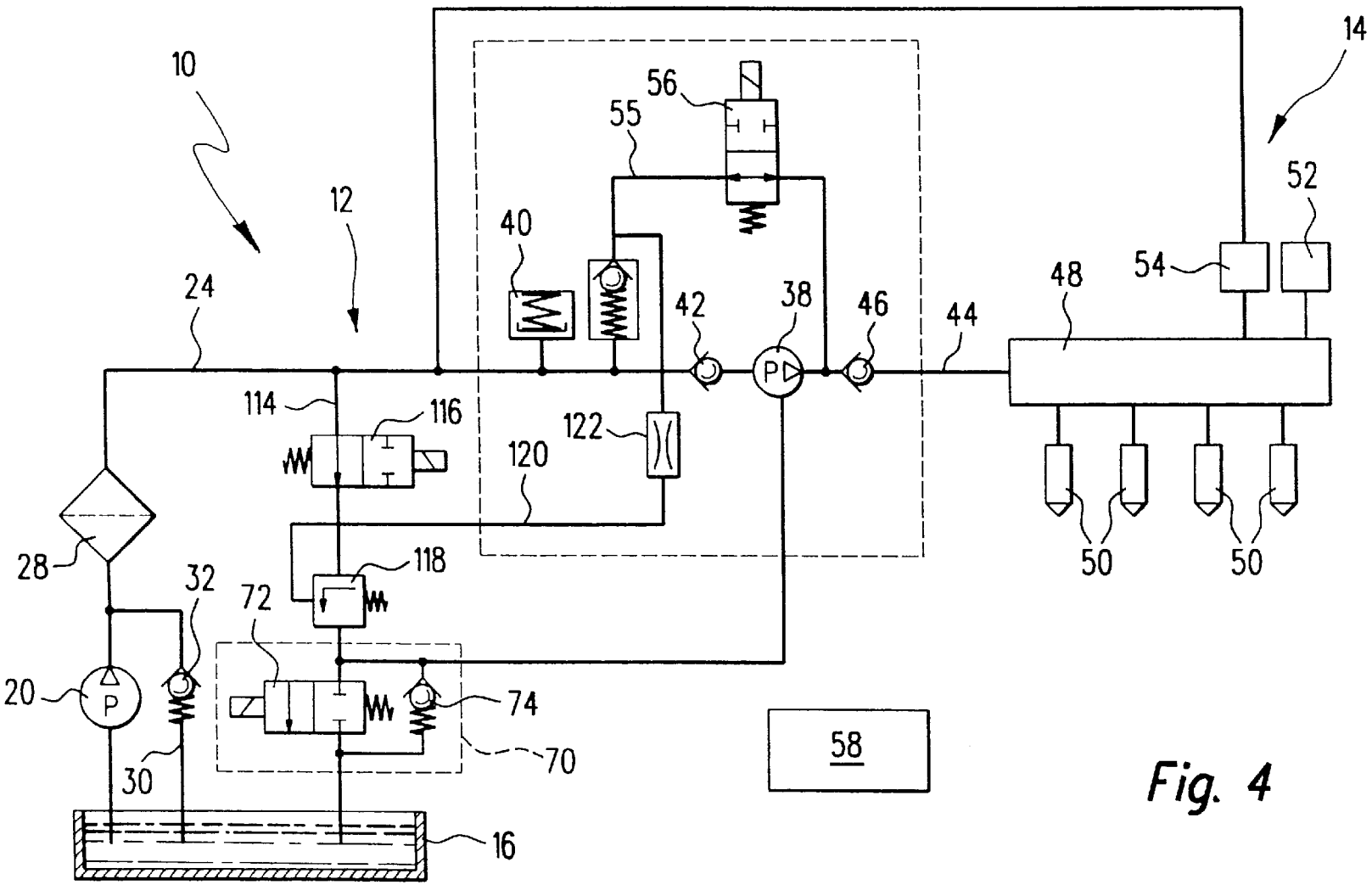
FIG. 4 shows a depiction similar to FIG. 1 of a third exemplary embodiment of a fuel system.

FIG. 4 shows another exemplary embodiment of a fuel system 10. Here, too, elements and parts, which have functions equivalent to those in the exemplary embodiments shown in FIGS. 1 to 3, are provided with the same reference numerals and are not explained in detail again.

By contrast with the exemplary embodiment shown in FIG. 3, in the exemplary embodiment shown in FIG. 4, the region of the low-pressure fuel line 24 between the filter 28 and the pressure damper 40 can be connected to the region of the leakage line 68 between the high-pressure pump 38 and the valve device 70 by means of a connecting line 114, a shutoff valve 116, and a pressure relief valve 118. In addition, the line 55 that contains the quantity control valve 56 can be connected by means of a flushing line 120 to the region of the connecting line 114 between the shutoff valve 116 and the pressure relief valve 118. The flushing line 120 contains a throttle 122.

The foregoing relates to preferred exemplary embodiments of the invention, it being understood that other variants and embodiments thereof are possible within the spirit and scope of the invention, the latter being defined by the appended claims.

What is claimed is:

1. A fuel system (10) for supplying fuel (18) from a reservoir (16) to an internal combustion engine, comprising a reservoir (16), a first fuel pump (20) whose input is connected to the reservoir (16), a second fuel pump (38) whose input is connected to the first fuel pump (20), at least one injection valve (50), which is connected to the second fuel pump (38) and can supply fuel (18) at least indirectly into a combustion chamber of the internal combustion engine, a leakage line provided between the second fuel pump and the reservoir, and a valve device (70) in the leakage line (68), the valve device (70) including a shutoff function (72) and a pressure relief function (74) that are connected in parallel with each other.

2. The fuel system (10) according to claim 1, wherein the same valve element (88) is used for both functions (72, 74) in the valve device (70).

3. The fuel system (10) according to claim 1 wherein the shutoff function (72) of the valve device (70) can be electrically triggered.

4. The fuel system (10) according to claim 3, wherein the valve device (70) comprises a valve element (88) that is prestressed (94) to perform the pressure relief function (74) and can be electrically actuated counter to the prestressing force in order to disable the shutoff function (72).

5. The fuel system (10) according to claim 1, wherein the valve device (70) is situated in the vicinity of the engine.

6. The fuel system (10) according to claim 4, wherein the valve device (70) is situated in the vicinity of the second fuel pump (38).

7. The fuel system (10) according to claim 1, wherein the valve device (70) is situated in the vicinity of the reservoir (16) and the second fuel pump (38) is provided with a bypass line (110) that contains a throttle restriction (112) and leads from the input of the second fuel pump (38) to the leakage line (68), and wherein the cross section of the throttle restriction (112) is selected so that during normal operation, the increase in the temperature of the fuel (18) in the reservoir (16) is less than a limit value.

8. The fuel system (10) according to claim 4, wherein the valve device (70) is situated in the vicinity of the reservoir (16) and the second fuel pump (38) is provided with a bypass line (110) that contains a throttle restriction (112) and leads from the input of the second fuel pump (38) to the leakage line (68), and wherein the cross section of the throttle restriction (112) is selected so that during normal operation, the increase in the temperature of the fuel (18) in the reservoir (16) is less than a limit value.

9. A method for operating the fuel system (10) according to claim 1, wherein the shutoff function (72) of the valve device (70) is activated immediately after the engine is turned off and is deactivated immediately after the engine is started.

10. The method according to claim 9, further comprising continuing to operate the first fuel pump (20) for a limited time after the engine is turned off.

11. The method according to claim 9, further comprising recording the parameters (60, 62, 64, 66) relevant for a hot start of the engine, and triggering the first fuel pump (20) and/or the valve device (70) as a function of the recorded parameters.

12. The method according to claim 10, further comprising recording the parameters (60, 62, 64, 66) relevant for a hot start of the engine, and triggering the first fuel pump (20) and/or the valve device (70) as a function of the recorded parameters.

13. The method according to claim 11, wherein the parameters (60,62,64,66) include a cooling water temperature (60) and/or an intake air temperature (62) and/or a speed (64) and/or a load (66) of the engine.

14. The method according to claim 12, wherein the parameters (60,62,64,66) include a cooling water temperature (60) and/or an intake air temperature (62) and/or a speed (64) and/or a load (66) of the engine.

15. The method according to claim 9, further comprising the step of adjusting the pressure at the input of the second fuel pump (38) by means of the speed of the first fuel pump (20).

16. A computer readable medium having a computer program for executing the method according to claim 9, when the computer readable medium is run on a computer.

17. The computer readable medium according to claim 16, wherein the computer readable medium is a flash memory.

18. A control and/or regulating unit (58) for controlling and/or regulating the fuel system (10) according to claim 1, the control and/or regulating unit further comprising a computer program controlling the valve device (70) to activate the shutoff function (72) immediately after the engine is turned off and to deactivate the shutoff function immediately the engine is turned on.

* * * * *